US006010165A

United States Patent [19]

Santarelli et al.

[11] Patent Number: 6,010,165

[45] Date of Patent: Jan. 4, 2000

[54] DOOR LATCH WITH CHILD SECURITY LOCK AND UNLOCKING ASSEMBLY

[75] Inventors: Pat Santarelli, Pickerington, Ohio; Reginald Leo McDonald, Macomb Township, Macomb County; Eric Oswin Gottschling, Sterling Heights, both of Mich.

[73] Assignee: General Motors Corporation, Detroit, Mich.

[21] Appl. No.: 09/157,667

[22] Filed: Sep. 21, 1998

[51] Int. Cl.[7] ..... E05C 3/06

[52] U.S. Cl. ..... 292/216; 292/DIG. 27; 292/DIG. 65

[58] Field of Search ..... 292/216, DIG. 65, 292/DIG. 27, 336.3, 169.11; 70/262, 263, 264

[56] References Cited

U.S. PATENT DOCUMENTS

| | | | |
|---|---|---|---|
| 4,756,563 | 7/1988 | Garwood et al. | 292/216 |
| 5,046,769 | 9/1991 | Rimbey et al. | 292/216 |
| 5,054,827 | 10/1991 | Konchan et al. | 292/216 |
| 5,100,185 | 3/1992 | Menke et al. | 292/216 |
| 5,106,135 | 4/1992 | Menke et al. | 292/216 |
| 5,277,461 | 1/1994 | Dzurko et al. | 292/216 |
| 5,308,128 | 5/1994 | Portelli et al. | 292/216 |
| 5,738,394 | 4/1998 | Arabia, Jr. et al. | 292/216 |
| 5,762,383 | 6/1998 | Gomi | 292/216 |

*Primary Examiner*—Darnell M. Boucher
*Assistant Examiner*—John B. Walsh
*Attorney, Agent, or Firm*—Kathryn A. Marra

[57] ABSTRACT

A vehicle door latch mechanism includes a latch assembly, an inside latch handle assembly, an outside latch handle assembly, a lock assembly and a child security assembly. An unlocking assembly is disposed between the lock assembly and the inside latch handle assembly. The unlocking assembly interrelates the inside latch handle assembly and the lock assembly so that operating the inside latch handle unlocks the door. This allows a person to unlatch the door from outside the door even when the door is latched and locked, and even when the child security lock is activated.

10 Claims, 8 Drawing Sheets

DOOR LATCH WITH CHILD SECURITY LOCK AND UNLOCKING ASSEMBLY

TECHNICAL FIELD

The present invention relates to vehicle door latches for passenger vehicles and more particularly to door latches having a child security lock.

BACKGROUND OF THE INVENTION

Vehicle makers now provide rear door latch assemblies with child security locks. The security locks allow a person to disable the inside latch opening lever for the rear doors simply by moving a lever or switch. In theory, this allows parents or other caregivers to prevent a child from opening the door while the vehicle is moving, or at other inappropriate times. Though the best security locks serve their purpose well, they may frustrate the caregiver with inconvenience. Consider the common situation where the caregiver has left the vehicle and the doors have been locked. The child still sits in the rear seat awaiting assistance to leave the vehicle. The caregiver cannot open the rear door from the outside because someone just locked the doors. The child cannot open the door from the inside because the security lock is engaged. The child may not be able to unlock the door from the inside, depending on the age of the child and the design of the lock. Thus, the caregiver must get the keys, open a front door, unlock the back door, open the back door, remove the child, close the back door, lock the vehicle, and close the front door. This scenario can also occur in a truncated form when someone other than a child is in the back seat and seeks to exit the vehicle against the reality of the child security lock.

SUMMARY OF THE INVENTION

An object of the invention is to improve vehicle door latches having a child security assembly so that a vehicle door can be unlocked from inside the door by operating the inside door latch handle.

A further object of the invention is to allow the door to be unlocked from the inside without allowing the door to be unlatched from the inside. This avoids defeating the child security assembly.

A feature of the invention is an unlocking assembly interrelating the inside latch handle and the door's lock assembly allowing the inside latch handle to engage the lock assembly and unlock the door when a person lifts the inside latch handle.

With this present invention, the caregiver can simply instruct the child to unlatch the door. The child, of course, cannot unlatch the door because the child security lock is engaged, but the child can pull the inside latch handle and unlock the door, allowing the caregiver to unlatch the door from the outside. This saves time and frustration.

BRIEF DESCRIPTION OF THE DRAWINGS

Other advantages of the present invention will be readily appreciated as the same becomes better understood by reference to the following detailed description when considered in connection with the accompanying drawings wherein.

DESCRIPTION OF THE PREFERRED EMBODIMENT

Referring to the FIGS. wherein like numerals indicate like or corresponding parts throughout the several views, a vehicle door latch mechanism is generally shown at 10. The vehicle door latch 10 has the same basic arrangement as the vehicle door latches disclosed in U.S. Pat. No. 4,756,563 granted to Stephen L. Garwood and Jeffrey Konchan, Jul. 12, 1988 for a vehicle door latch, and U.S. Pat. No. 5,054,827 granted to Jeffrey L. Konchan and Jiri Paulik, Oct. 8, 1991 for a vehicle door latch, both of which are hereby incorporated by reference into this patent specification.

Figure 1:
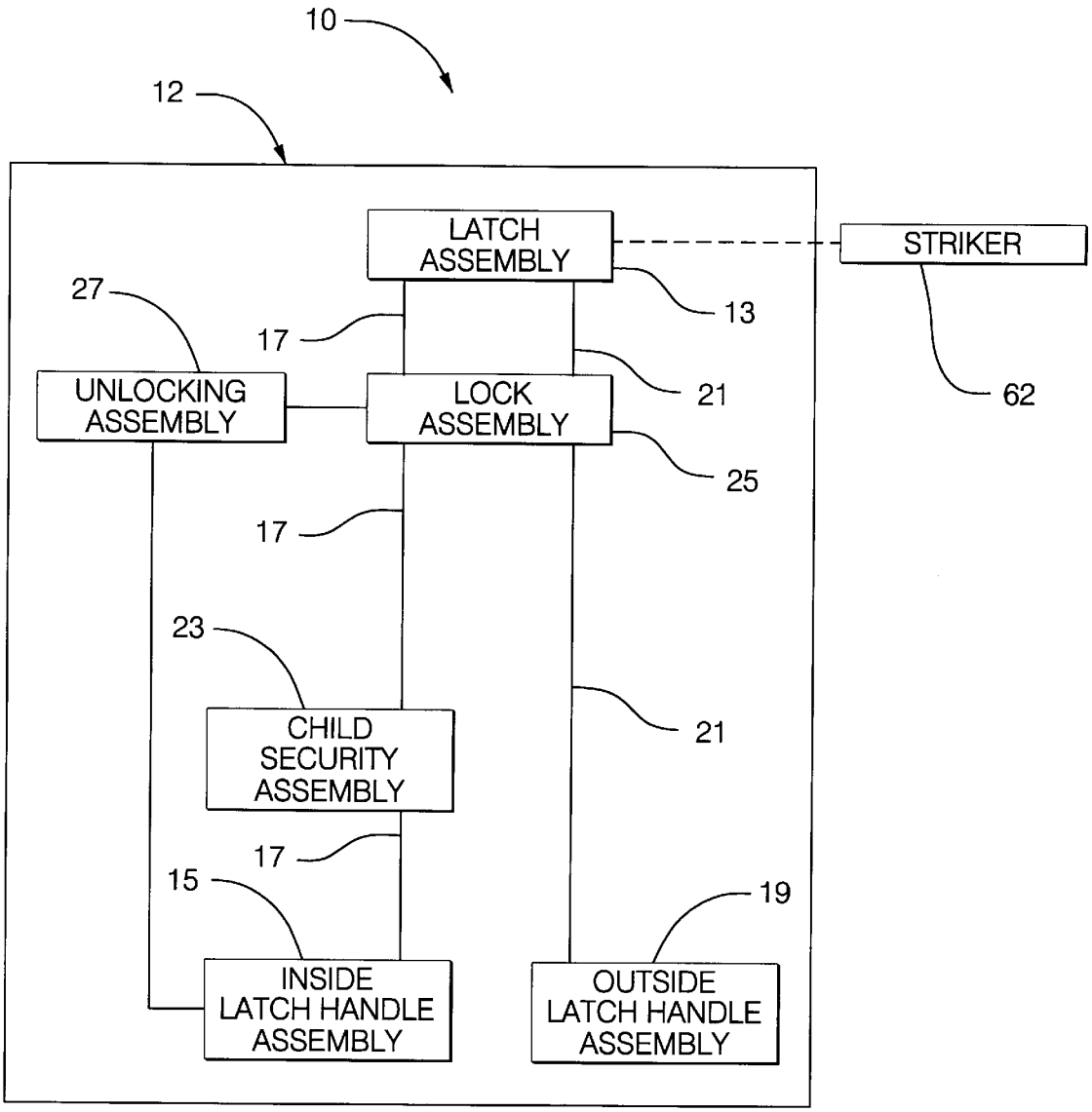
FIG. 1 is gram showing the invention and its major elements.

In one broad statement of the invention, the vehicle door latch mechanism 10 includes the major elements shown in FIG. 1 and described below. The first element is an enclosure 12 for housing and supporting the other elements. The enclosure 12 mounts in a vehicle door (not shown) opposite a striker 62 that is mounted on the door frame (not shown). Next is a latch assembly 13 mounted in the enclosure 12. The latch assembly 13 latches to and unlatches from the striker 62 under predetermined conditions. The latch assembly 13 and its parts are discussed in detail below in the section entitled "Latch Assembly." An inside latch handle assembly 15 mounts on the enclosure 12 and interconnects with the latch assembly 13 to define a first motion transfer path 17 wherein motion may be transferred from the inside latch handle assembly 15 to the latch assembly 13. The inside latch handle assembly 15 mounts on the enclosure 12 for movement from a rest position to an unlatching position to transfer motion along the first path 17 to the latch assembly 13 to unlatch the latch assembly. Similarly, an outside latch handle assembly 19 mounts on the enclosure 12 and interconnects with the latch assembly 13 to define a second motion transfer path 21 wherein motion may be transferred from the outside latch handle assembly 19 to the latch assembly 13. The outside latch handle assembly 19 mounts on the enclosure 12 for movement from a rest position to an unlatching position to transfer motion along the second path 21 to the latch assembly 13 to unlatch the latch assembly. The inside and outside latch handle assemblies 15, 19 and their respective parts are discussed in detail below in the section entitled "Latch Handle Assemblies." A child security assembly 23 mounts on the enclosure 12 along the first path 17. The child security assembly 23 moves between a first position in which the child security assembly effects motion transfer along the first path 17 and a second position in which the child security assembly interrupts motion transfer along the first path to prevent the inside latch handle assembly 15 from unlatching the latch assembly 13. The child security assembly 23 and its parts are discussed in detail below in the section entitled "Child Security Assembly." A lock assembly 25 is disposed on the enclosure along the first and second paths 17, 21. The lock assembly 25 moves between an unlocking position in which the lock assembly effects motion transfer along the paths 17, 21 and a locking position in which the lock assembly interrupts motion transfer along the paths. This lock assembly 25 and its parts are discussed in detail below in the section entitled "Lock Assembly." An unlocking assembly 27 is disposed between the inside latch handle assembly 15 and the lock assembly 25 to move the lock assembly to the unlocking position when the inside handle assembly moves to the unlatching position.

In a somewhat different statement of the invention, the vehicle door latch mechanism 10 includes these following elements. The first element is the enclosure generally indicated at 12 for housing and supporting the various other elements. The second element is a latching assembly disposed in the enclosure 12 and adapted to move from an unlatched configuration to a latched configuration. This latching assembly differs from the aforesaid latch assembly 13. This latching assembly is discussed in detail below in the section entitled "Latch Assembly." An unlatching arm, referred to here as the "intermittent member" 14, engages the latching assembly and is movable from a rest position to an unlatched position in which the intermittent member moves the latching assembly into the unlatched configuration. An inside latch handle assembly 15 and an outside latch handle assembly 19 each operate adjacent the intermittent member 14 for movement from a rest position to an unlatching position to engage the intermittent member and move the intermittent member to the unlatched position. A lock assembly 25 is disposed on or in the enclosure and engages the intermittent member 14. The lock assembly 25 can move between an unlocked position and a locked position. In the unlocked position, the lock assembly 25 positions the intermittent member 14 so that the intermittent member will engage the inside and outside latch handle assemblies 15, 19 when either of the latch handle assemblies moves toward the unlatching position. In the locked position, the lock assembly 25 isolates the intermittent member 14 from the inside and outside latch handle assemblies 15, 19. The inside latch handle assembly 15 includes an output element 16, 18 disposed adjacent the intermittent member 14, and an input element 20 positioned adjacent the lock assembly 25. The input element 20 includes an abutment 22 moving the lock assembly 25 to the unlocked position when the input element moves from the rest position to the unlatching position. Finally, the invention includes a child security assembly 23 disposed between the input and output elements 16, 18 and 20 of the inside latch handle assembly. The child security assembly 23 can move between a first position in which the child security assembly transfers motion between the input and output elements 20 and 16, 18, and a second position in which the child security assembly transfers no motion between the input and output elements. In this manner, the inside latch handle assembly 15 cannot engage the intermittent member 14 to move the latching assembly to the unlatched configuration.

The various elements mentioned above are described in greater detail below.

Enclosure

The latch mechanism 10 includes a three-piece enclosure 12 that comprises plastic housing 24, metal face plate 26 and metal back plate 28. The plastic housing 24 and the metal back plate 28 are held together by three flanged, internally threaded bushings 29, 30, 31 that are inserted into three holes in the plastic housing, then through three aligned holes in the back plate and then flanged over the back plate. The metal face plate 26 has three bolt holes that are aligned with the bushings 29, 30, 31 when the metal face plate is attached to the plastic housing 24 by a screw 38. The metal face plate 26 and the metal back plate 28 have lower portions below the plastic housing 24 that are held together by a flanged stud 40 that has projecting pins at each end that are inserted in holes in the plates and peened or headed over as shown in FIGS. 2, 5, and 6, for example.

Latch Assembly

The latch assembly 13 of the vehicle door latch mechanism 10 comprises a fork bolt lever generally indicated at 42 and a cooperating detent lever 44 that are pivotally mounted on bushings 30 and 29, respectively, and located in a chamber of the plastic housing 24 behind the metal face plate 26. The fork bolt lever 42 is biased clockwise by a coil spring 50. The coil spring 50 is disposed in a curved slot in the plastic housing 24 behind the fork bolt lever 42, and it engages a depending pin 52 of the fork bolt lever at one end. As shown in FIGS. 5 and 6, the detent lever 44 is biased counterclockwise into engagement with the fork bolt lever 42 by a coil spring 54 that surrounds the bushing 29 and that has one end engaging the plastic housing 24 and the other end engaging an ear 56 of the detent lever. The detent lever 44 engages the fork bolt lever 42 in its unlatched position as shown in phantom in FIG. 5, and engages and holds the fork bolt lever in intermediate and full latched positions against the bias of spring 50 as shown in FIG. 6 in phantom and solid line, respectively. The operation is explained more fully below.

Figure 2:
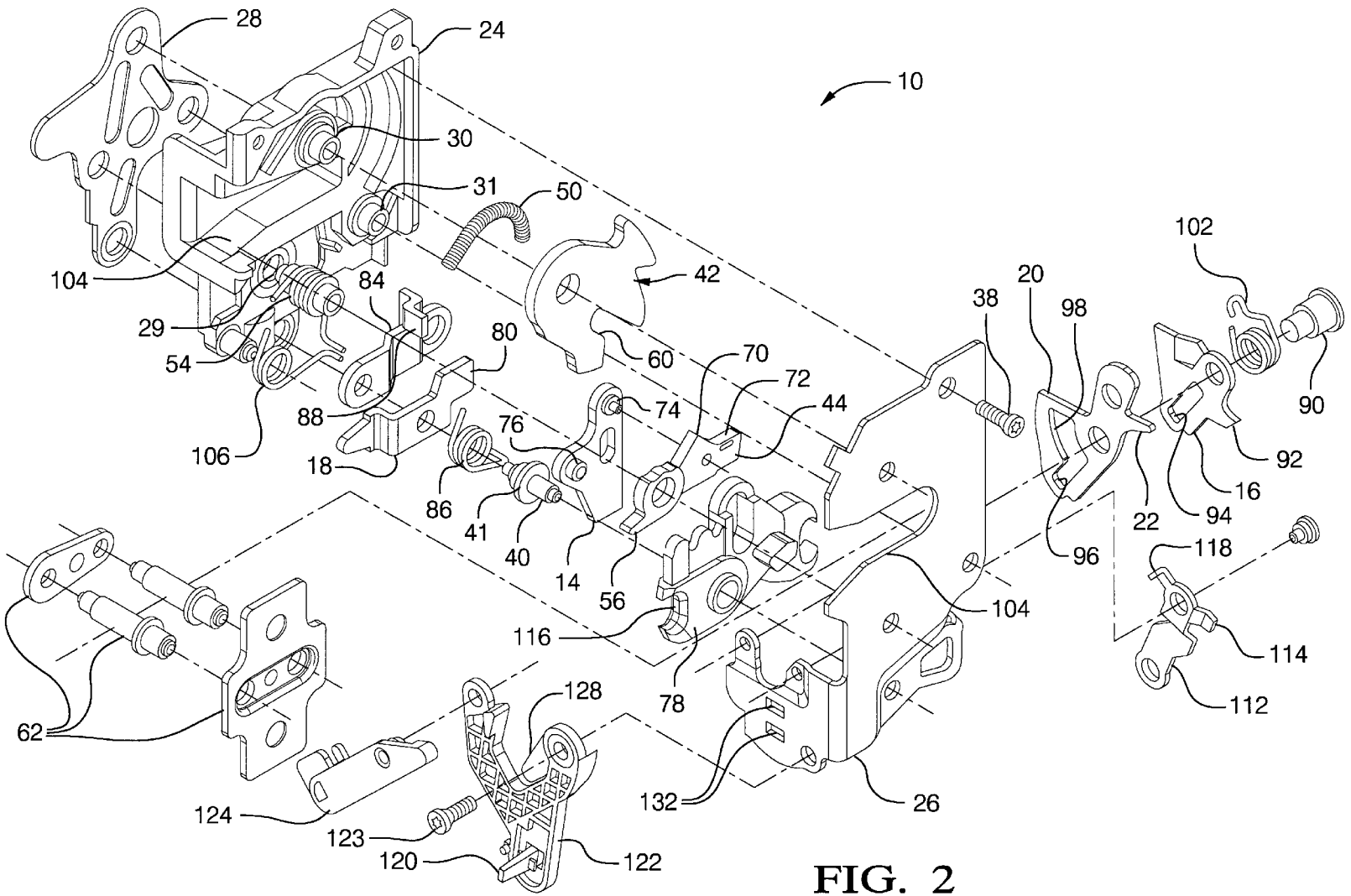
FIG. 2 an exploded perspective view of the door latch mechanism.
Figure 5:
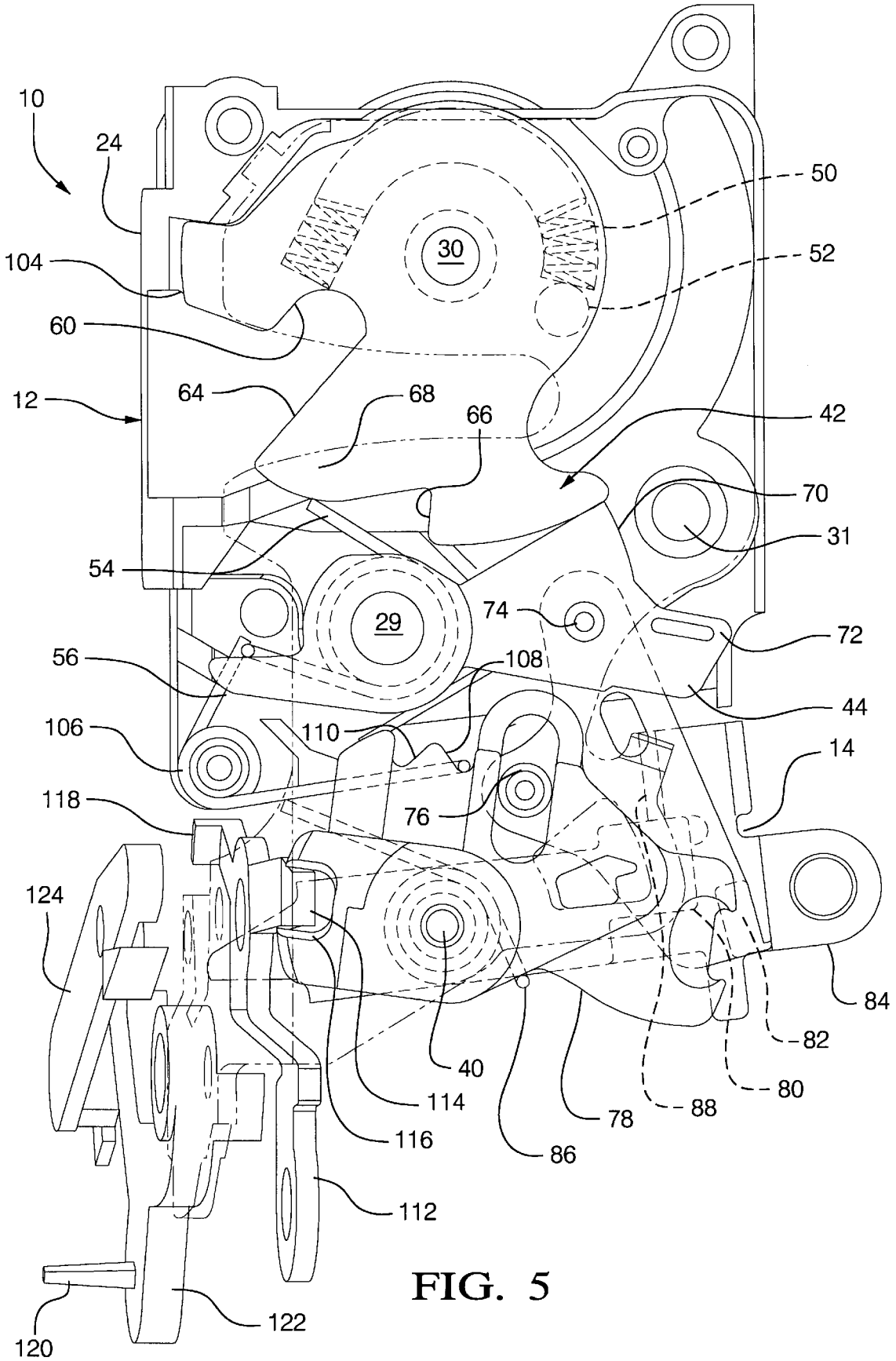
FIG. 5 is a front view of the latch mechanism with the enclosure partially cut away to show elements of the latch assembly, the latch handle assemblies and the lo assembly.
Figure 6:
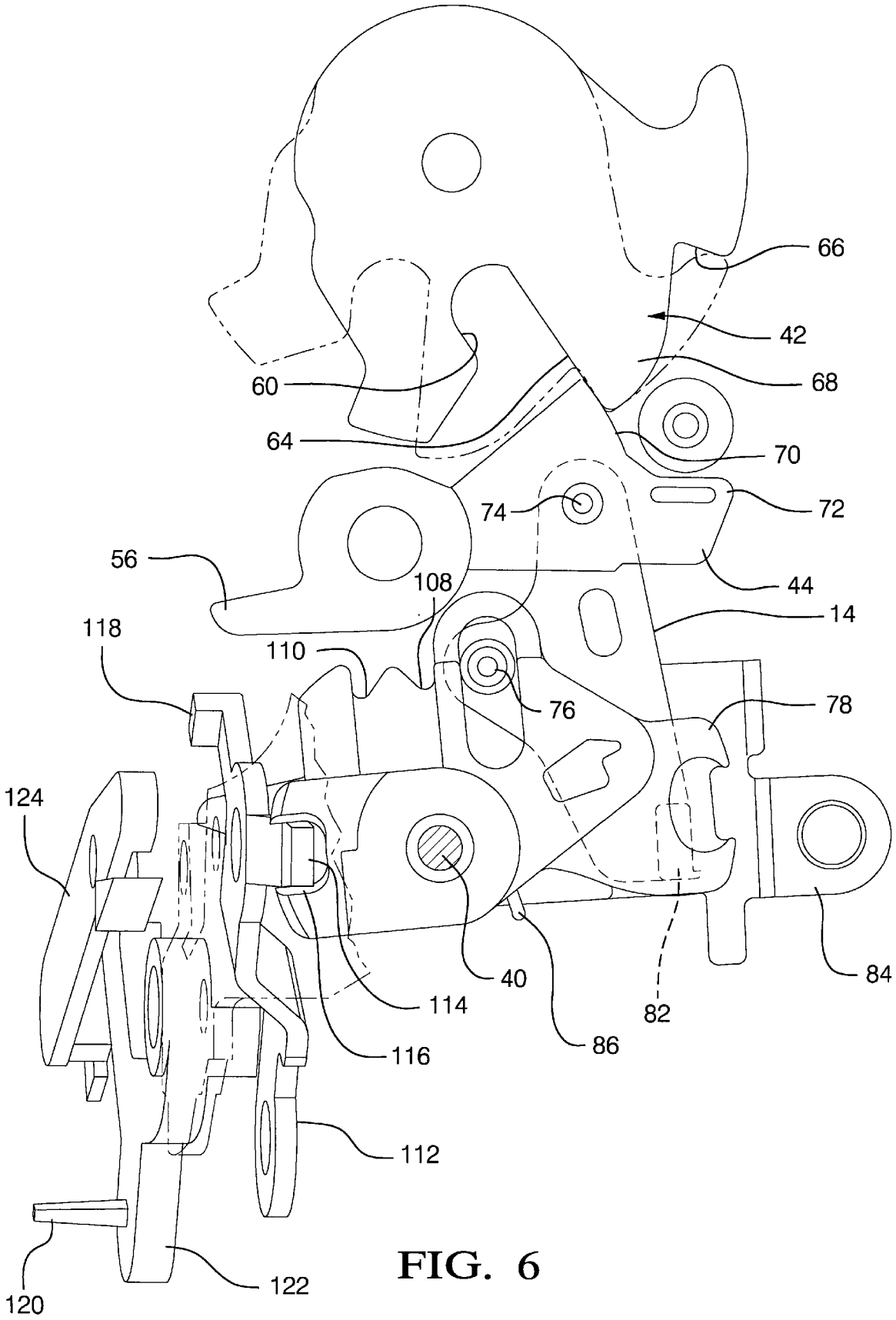
FIG. 6 is a fragmentary front view of the latch mechanism showing elements of the latch assembly, portions of the latch handle assemblies and the locking assembly.

Referring now to FIGS. 2, 5, and 6, the fork bolt lever 42 has a conventional slot or throat 60 for receiving and retaining a striker member 62, such as that shown in the U.S. patents discussed above. The striker member 62 is attached to the door pillar to latch the door in the closed position (not shown). The fork bolt lever 42 also includes a primary latch shoulder 64, an intermediate latch shoulder 66 and a radially projecting foot 68. The fork bolt lever 42 also has a plastic coating (not shown) that covers a surface of the slot that is engaged by the striker 62 for energy absorption and quiet operation when the vehicle door is slammed shut.

The detent lever 44 has a sector shaped catch 70 that engages the radially projecting foot 68 when the fork bolt lever 42 is in the unlatched position as shown in FIG. 5. The sector shaped catch 70 positively engages the primary and intermediate latch shoulders 64, 66 to hold the fork bolt lever 42 in either the full or intermediate latched positions shown in FIG. 6 in solid line and phantom respectively. The detent lever 44 also includes a plastic coating having a slotted portion that provides an integral bumper 72. The bumper 72 engages the bushing 31 to stop counterclockwise pivoting of the detent lever 44 under the bias of coil spring 54. This bumper 72 also absorbs energy and quiets operation when the door is slammed shut.

The aforesaid intermittent member 14 engages the latching assembly and specifically operates the detent lever 44. This intermittent member 14 may be considered part of the latch assembly 13, or it may be viewed as a separate item. This description refers to the latch assembly as the assembly that includes the intermittent member 14, and the latching assembly (not numbered) as a similar assembly that does not include the intermittent member 14. The intermittent member 14 is located in the chamber of the plastic housing behind the detent lever 44. It has two integral pivot pins 74 and 76. Pivot pin 74 is journalled in a hole on the detent lever 44 so that the detent lever rotates clockwise from the position shown in FIG. 6 (and out of latched engagement with the fork bolt lever 42) to a depressed position when the intermittent member 14 is pulled down. The pivot pin 76 is disposed in a slot of a locking lever 78 so that the locking lever pivots the intermittent member 14 counterclockwise about pivot pin 76 when the locking lever is rotated clockwise from their respective positions shown in FIG. 6 to their respective positions shown in FIG. 5. This movement of the intermittent member can also be seen in FIGS. 4A and 4B. The locking lever 78 is journalled on the stud 40 between the flange 41 and the face plate 26. The operation of the locking lever 78 is explained in greater detail below in connection with the description of the lock assembly 25.

Latch Handle Assemblies

The outside latch handle assembly 19 includes a transfer lever 18. The transfer lever 18 is journalled on a reduced diameter portion of the stud 40 spaced behind the flange 41. The transfer lever 18 has an ear 80 at one end that is engageable with an integral, rearwardly projecting tab 82 of the intermittent member 14 so that the intermittent member is pulled down when the transfer lever 18 is rotated counterclockwise as viewed in FIG. 4A.

The outside latch handle assembly 19 further includes outside operating lever 84 and a coil return spring 86. The outside operating lever 84 is also journalled on the reduced diameter portion of the stud 40 behind the transfer lever 18. It has a bent tab 88 that engages ear 80 of the transfer lever 18 so that the outside operating lever 84 rotates the transfer lever 18 downwardly when it is rotated downwardly about the stud 40. The outside operating lever 84 is connected by suitable linkage for rotation by an outside door handle (not shown).

The coil return spring 86 is disposed around the stud 40 and located between the flange 41 and the transfer lever 18. One end of the coil spring 86 engages the bottom of transfer lever 18 and the other end engages the bottom of the plastic housing 24 above the transfer lever 18 so that the transfer lever and outside operating lever 84 are biased upwardly to a rest position where tab 84 engages the bottom of the plastic housing 24.

The inside latch handle assembly 15 generally includes the input element 20 that is pivotally mounted on the enclosure 12 with a pivot pin 90, and the output element 16, 18 that is mounted on the enclosure 12 adjacent the input element 20 and the intermittent member 14.

In the present case, the output element includes two parts. The first part is the transfer lever 18. The second part is the transfer plate 16. The transfer plate 16 is operatively mounted between the input element 20 and the transfer lever 18 in order to transfer motion between the input element 20 and the transfer lever 18. The two-part output element 16, 18 includes a lever arm adapted to transfer motion to the intermittent member 14. In the present case, the lever arm is the transfer lever 18, although the lever arm may take other forms and still accomplish the function of transferring motion. The transfer plate 16 includes a projection 92 that contacts the transfer lever 18. The transfer plate 16 is mounted on the pivot pin 90 adjacent the input element 20.

The input element 20 selectively engages the output element in the following manner. The transfer plate 16 of the output element defines a first elongated slot 94 extending radially from the pivot pin 90 between a first end adjacent the pivot pin and a second end remote from the pivot pin. The input element 20 defines a second elongated slot 96 extending radially from the pivot pin 90 between a first end adjacent the pivot pin and a second end remote from the pivot pin. The first and second slots 94, 96 are of the same size and shape. The input element 20 further defines an arcuate slot 98 having an arc center at the pivot pin 90. In other words, the slot 98 curves like an arc having a center at the pivot pin 90. The arcuate slot 98 extends generally from a first end coextensive with the second end of the second elongated slot 96 to a second end remote from the elongated slot 96. The second elongated slot 96 and the arcuate slot 98 define a single continuous hole through the input element 20.

The transfer plate 16 and the input element 20 are interconnected by a connector 100. This connector 100 is part of the child security assembly, which will be discussed in greater detail later in the description. The connector 100 moves between a first position and a second position, depending on the status of the child security assembly. When in the first position, the connector 100 is disposed through the elongated slot 96 in the input element 20 at the first end and through the elongated slot 94 in the transfer plate 16 of the output element at the first end, where the two elongated slots 94, 96 are aligned. The connector 100 connects the input element 20 and the transfer plate 16 in the sense that the connector transfers motion between the input element 20 and the transfer plate 16, causing the transfer plate to move when the input element moves. But this motion transfer occurs only when the connector 100 is at or near its first position.

Figure 3A:
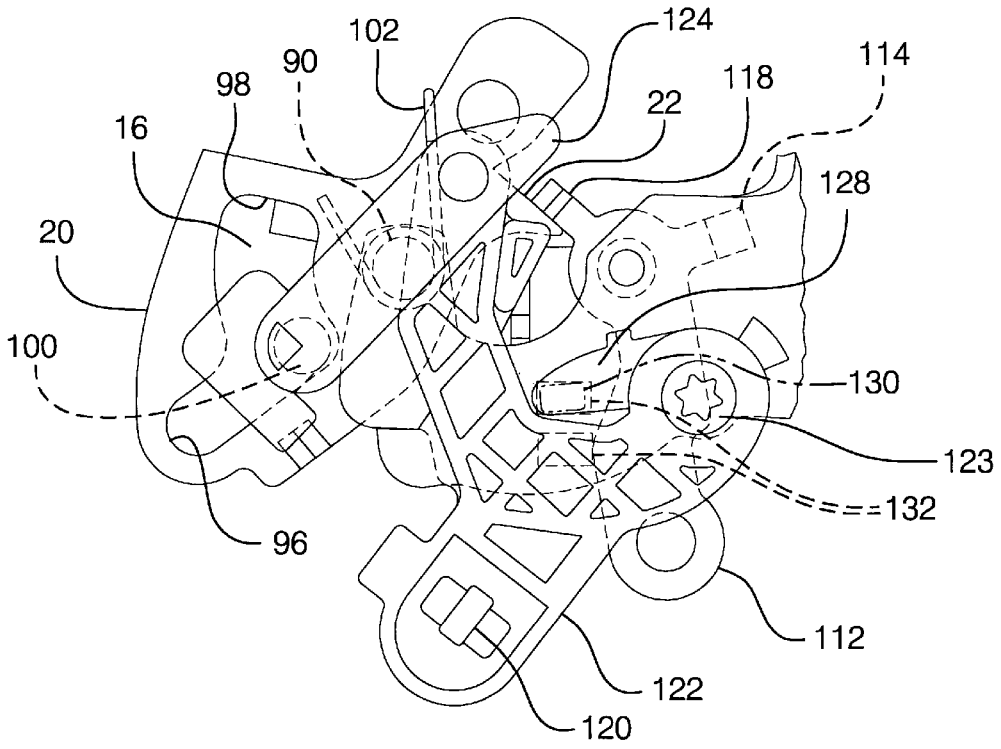
FIG. 3A is a fragmentary side view of the lower portion of the door latch mechanism showing the child security assembly, a portion of the inside latch handle assembly, and the unlocking assembly, where the child security assembly is engaged and the inside latch handle assembly is in the rest position.
Figure 3B:
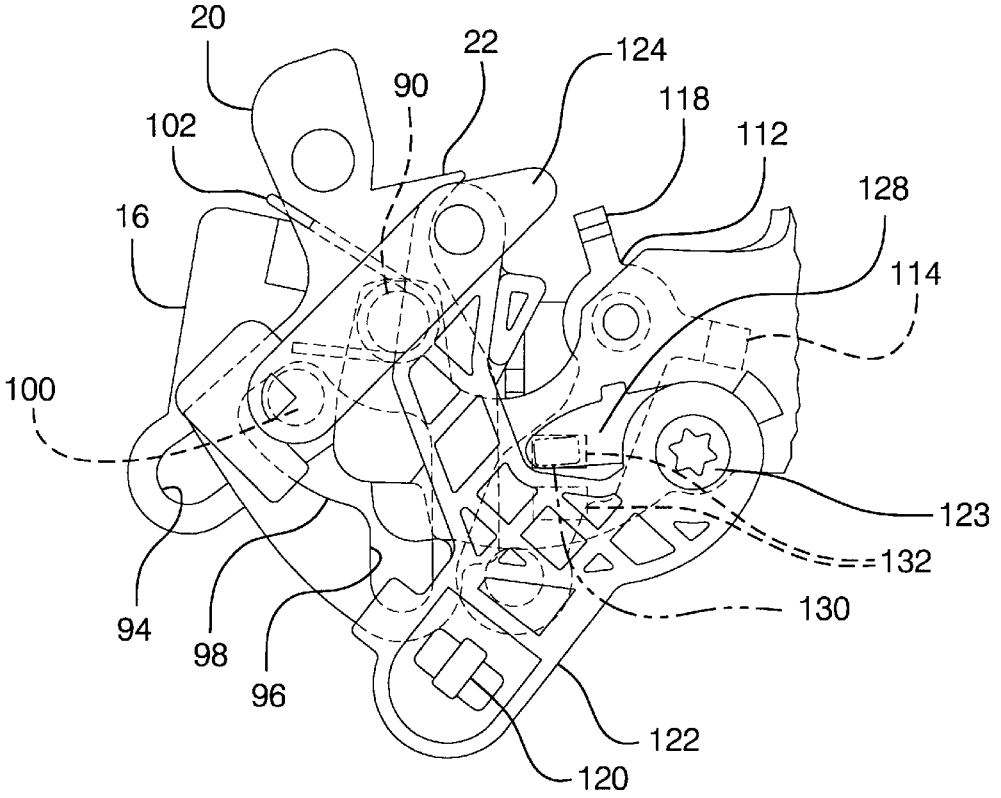
FIG. 3B is a view similar to that shown in FIG. 3A, but showing the inside latch handle assembly in the unlatching position.

When the connector 100 is in the second position, the connector is disposed through the elongated slots 94, 96 at the second ends of the slots. The connector 100 is therefore free to move along the arcuate slot 98 toward the second end of the arcuate slot when the input element 20 moves from the rest position to the unlatching position. This is shown in FIGS. 3A and 3B. This is a selectively engageable free-wheeling type of connection between the input element 20 and the transfer plate 16. The input element 20 will transfer no motion to the transfer plate 16 via the connector when the connector is in the second position.

Figure 7A:
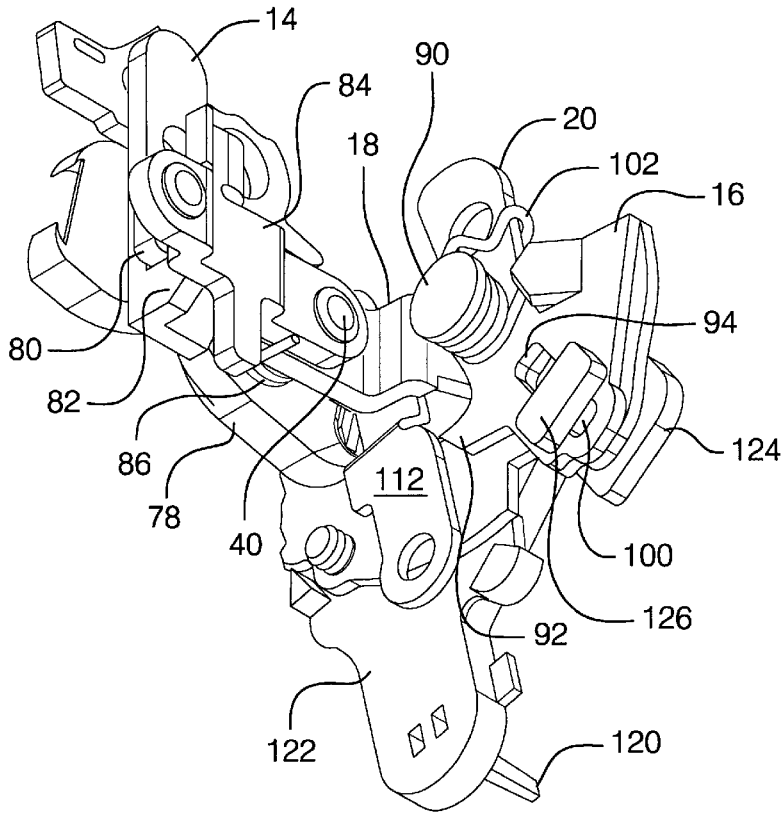
FIG. 7A is a fragmentary rear perspective view of the latch mechanism showing elements of the latch handle assemblies, the lock assembly and the child security assembly where the outside latch handle assembly is in the unlatching position and e child security assembly is disengaged.
Figure 7B:
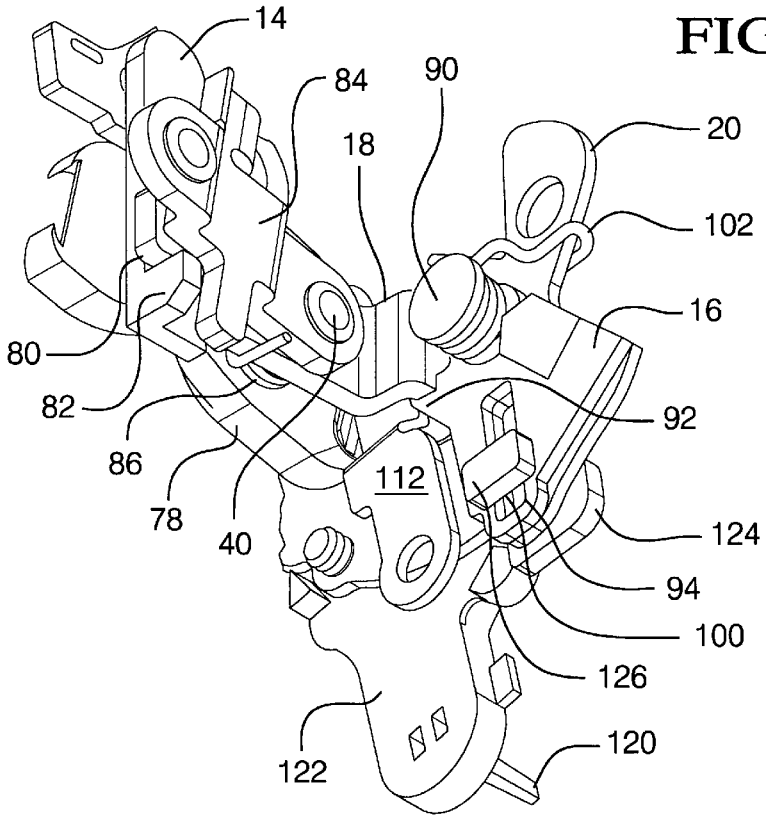
FIG. 7B is a view similar to the view in 6A showing the inside latch handle assembly in the unlatching position.

The input element 20 and the transfer plate 16 are also interconnected with a coil spring 102. As shown in FIGS. 7A and 7B, the coil spring 102 engages the input element 20 and the transfer plate 16. The coil of the coil spring 102 centers over the pivot pin 90. One end of the coil spring 102 extends over the input element 20, while the other end abuts a flange or projection on the transfer plate 16. The coil spring 102 biases the previously mentioned abutment 22 on the input element 20 toward the lock assembly 25.

The latch and latch handle assemblies operate as follows. When the door latch is in an unlatched and unlocked condition, the fork bolt lever 42 is poised to receive a conventional striker 62 that projects into aligned fishmouth slots 104 of the plastic housing 24 and the metal face plate 26 when the door is shut. The entering striker 62 engages the plastic coating at the back of the throat 60 and rotates the fork bolt lever 42 counterclockwise against the bias of spring 50 until the fork bolt lever is rotated to the full latch position shown in solid line in FIG. 6 where the fork bolt lever 42 captures the striker 62 in the throat 60. The fork bolt lever 42 is held in the full position by the catch 70 of the detent lever 44 engaging the primary latch shoulder 64 of the fork bolt lever. Alternatively, the fork bolt lever 42 may be held in the intermediate position by the catch 70 engaging the intermediate shoulder 66.

The catch 70 rides along the periphery of the fork bolt lever 42 under the bias of spring 54 (FIG. 5) as the fork bolt lever rotates counterclockwise from the unlatched position to the full latch position shown in FIG. 6. During this travel, the catch 70 rides under the foot into engagement with the intermediate latching shoulder 66 and then under the coated portion into engagement with the primary latching shoulder 64. It is to be noted that the engagement of the catch 70 with the intermediate latching shoulder 66 is sufficient to hold the vehicle door closed in the event that the vehicle door is not shut so completely that the catch engages the primary latch shoulder 64.

The vehicle door latch 10 is unlatched so that the vehicle door can be opened by operating either the inside or the outside latch handle assemblies 15, 19 to pull the intermittent member 14 down from the full latch position to the unlatch position shown in FIGS. 7A and 7B. As the intermittent member 14 is pulled down, it rotates the detent lever 44 against the bias of spring 54 from the latch position to the unlatch position. The fork bolt lever 42 is then free to rotate counterclockwise under the bias of spring 50 from the full latch position shown in solid line in FIG. 6 to the unlatch position shown in FIG. 5 as the striker 62 is pulled out of the aligned fishmouth slots 60 when the vehicle door is opened.

As stated earlier, the inside latch handle assembly 15 and the latch assembly 13 define a first motion transfer path 17. One can initiate motion along this path at the inside latch handle in the inside of the door (not shown). This action will transfer motion to the input element 20. The input element 20 will transfer the motion to the transfer plate 16, which in turn transfers motion to the transfer lever 18. The transfer lever 18 transfers motion to the intermittent member 14, which in turn transfers motion to the detent lever 44, which may release the fork bolt 42. The first motion transfer path 17 includes all of the foregoing elements 20, 16, 18, 14, 44, 42 disposed in series.

Similarly, the outside latch handle assembly 19 and the latch assembly 13 define a second motion transfer path 21. One can initiate motion along this path 21 at the outside latch handle on the outside of the door (not shown). This action will transfer motion to the outside operating lever 84, which in turn transfers motion to the transfer lever 18. The transfer lever 18 transmits motion to the intermittent member 14, which rotates the detent lever 44, which may release the fork bolt 42. The second motion transfer path 21 includes all of the foregoing elements 84, 18, 14, 44, 42 disposed in series.

Lock Assembly

Returning to FIGS. 4A and 4B, the vehicle door latch mechanism 10 includes a freewheeling-type lock assembly 25 for disconnecting the latch assembly so that operation of either the inside door handle or the outside door handle is ineffective in moving the detent lever 44. Said another way, this lock assembly 25 is disposed along the first and second motion transfer pathways 17, 21. Its function is to interrupt motion transfer along both pathways 17, 21 when the lock assembly 25 is engaged.

The lock assembly 25 comprises the locking lever 78 that is pivotally mounted on the stud 40 between the flange 41 and the metal face plate 26. As indicated above, the locking lever 78 is also connected to the intermittent member 14 by a pin and slot arrangement that allows these two parts to translate motion and pivot with respect to each other.

Figure 4A:
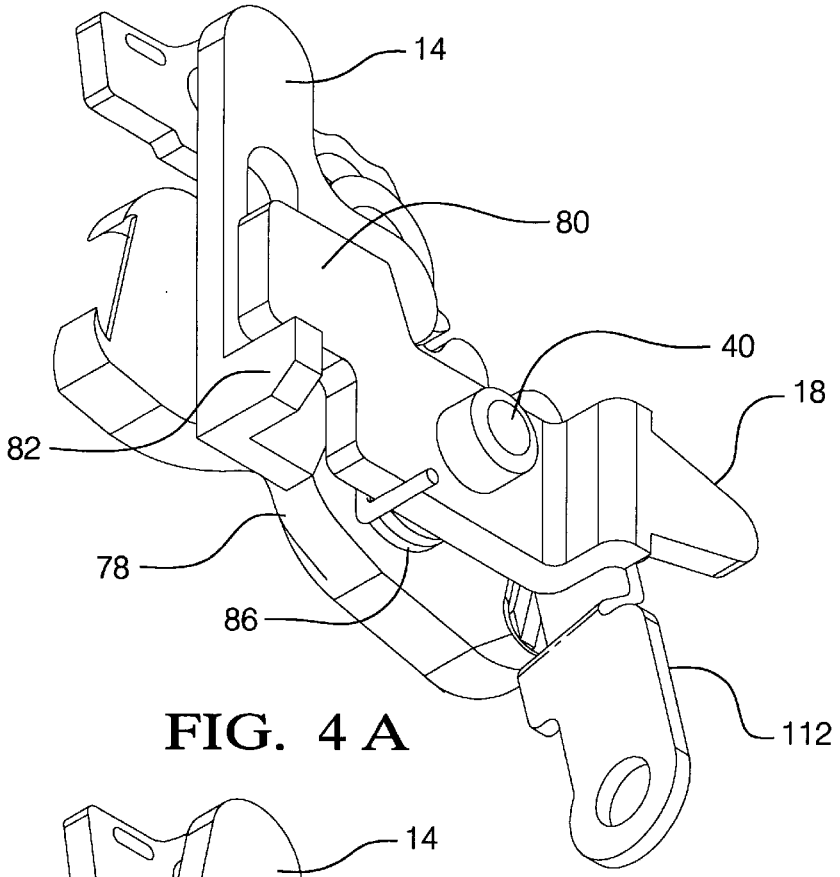
FIG. 4A is a fragmentary perspective rear view of the latch mechanism showing the lock assembly, the intermittent member and the transfer lever, where the lock assembly is in the unlocked position.
Figure 4B:
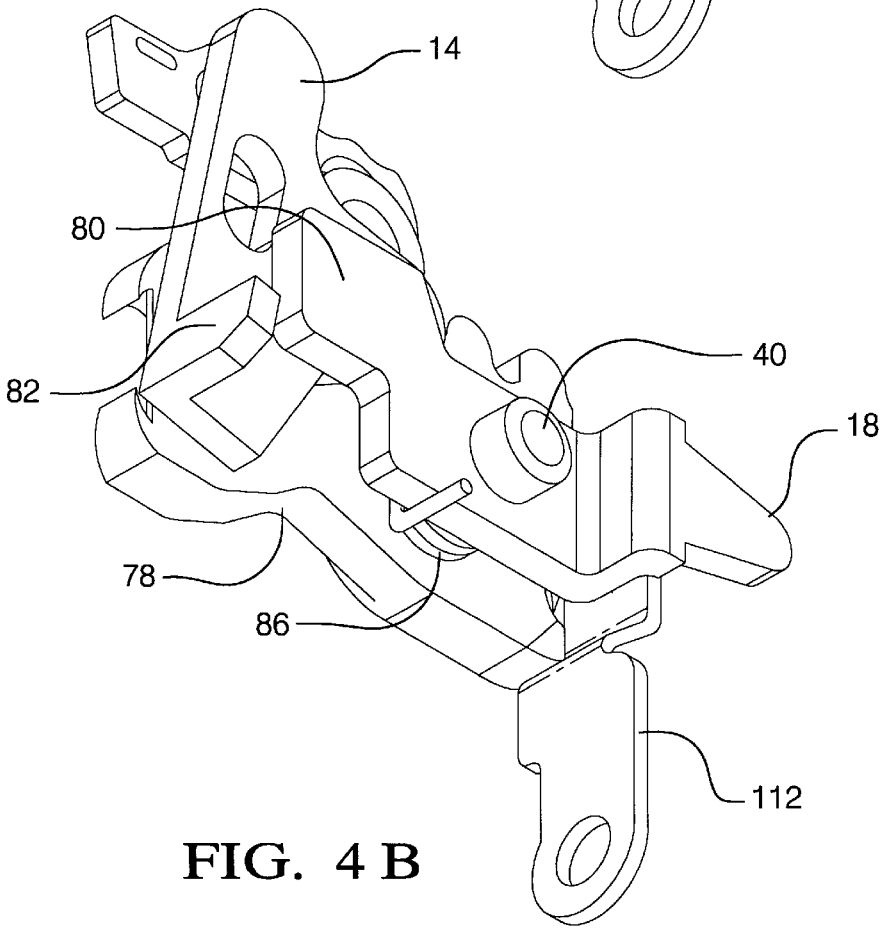
FIG. 4B is a view similar to that shown in FIG. 4A but showing the lock assembly in the locking position.

The locking lever 78 pivots on the stud 40 between an unlocked position shown in FIG. 4A and a locked position shown most plainly in FIG. 4B. The locking lever 78 is held in the unlocked position by a coil spring 106 that has one end mounted on the plastic housing 24 and the other end engaging a first detent notch 108 in the plastic locking lever. The plastic locking lever 78 may pivot from this position to the locked position. If this happens, the end of the coil spring 106 engages a second detent notch 110 in the locking lever 78 to hold it in the locked position.

The lock assembly 25 further comprises an inside lock operating lever 112 for pivoting the plastic locking lever 78 back and forth between the locked and unlocked positions. The inside lock operating lever 112 is pivotally mounted on the flange of the metal face plate 26 in front of the input element 20 for unlatching the door. The inside lock operating lever 112 is pivotally mounted with some appropriate fastener such as a flanged stud, screw, rivet, etc. The inside lock operating lever 112 includes a first tab 114 that engages in a slot 116 in one end of the plastic locking lever 78 so that the plastic locking lever is pivoted clockwise from the unlocked position shown in FIG. 6 to the locked position shown in FIG. 5 when the inside locking lever 112 is pivoted counterclockwise by an inside sill button or lock slide (not shown). The inside lock operating lever 112 further includes the second tab 118.

The lock assembly 25 operates as follows. When the vehicle door latch 10 is in a latched condition as shown in FIG. 6, the lock assembly 25 is actuated by rotating the locking lever 78 clockwise from the unlocked position shown in FIG. 6 to the locked position shown in FIG. 5. As indicated above, this can be accomplished through rotation of the inside lock operating lever 112 by an inside sill button or lock slide. Clockwise rotation of the locking lever 78 also rotates the intermittent member 14 counterclockwise about the pivot pin 74 that is journalled in the detent lever 44 due to the engagement of the second pivot pin 76 of the intermittent member in the slot of the locking lever. The intermittent member 14 is rotated counterclockwise from the unlocked position shown in FIG. 6 to the locked position shown in FIG. 5 moving the projection 82 out from under the ear 80 of the transfer lever 18. This can also be seen clearly in FIGS. 4A and 4B, where the intermittent member 14 moves from an unlocked position in FIG. 4A to a locked position in FIG. 4B. Consequently, when the door handles are operated so as to rotate the transfer lever 18 clockwise to the unlatching position, the ear 80 simply bypasses the projection 82 without transferring any motion to the intermittent member 14. In other words, the transfer lever 18 simply freewheels so that operating of the door handles is ineffective. This is the manner in which the lock assembly 25 may interrupt motion transfer along the first and second motion transfer pathways 17,21.

The lock assembly 25 is unlocked simply by rotating the locking lever 78 counterclockwise back to the unlocked position shown in FIG. 6 where the projection 82 is beneath the ear 80 of the transfer lever 18 (FIG. 4A) so that counterclockwise rotation of the transfer lever pulls the intermittent member 14 and the detent lever 44 down to the disengaged position shown in FIGS. 7A and 7B.

Unlocking Assembly

The unlocking assembly 27 includes the abutment 22 disposed on the inside latch handle assembly 15 and the second tab 118 disposed on the lock assembly 25. As stated, the second tab 118 is disposed on the inside lock operating lever 112. The abutment 22 is located on the input element 20 as shown best in FIGS. 2 and 3. If the lock assembly 25 is in the locked position, the abutment 22 engages the second tab 118 when the inside latch handle assembly 15 moves to the unlatching position so that the inside latch handle assembly 15 transfers motion to the lock assembly 25 to move the lock assembly to the unlocking position. In other words, the abutment 22 will engage and move the second tab 118 when the input element rotates counterclockwise as viewed in FIGS. 3A–D, but the abutment 22 will only engage the second tab 118 when the lock assembly 25 is in its locked position and the second tab 118 is in its most extreme counterclockwise (or left) position. In such a situation, the abutment 22 will move the second tab 118 to its most extreme clockwise (or right) position. In doing so, the abutment 22 will move the lock assembly 25 to its unlocked position. The abutment 22 will engage the second tab 118 even when the child security assembly 23 is engaged, and the input element 20 simply rotates without transferring any motion to the output elements 16, 18. The action of the unlocking assembly is best shown in FIGS. 3A–D. The coil spring 102 always biases the abutment 22 (clockwise in FIGS. 3A–D) into position where it will engage the second tab 118.

Child Security Assembly

The child security assembly 23 is mounted on the enclosure 12 along the first motion transfer pathway and is specifically located between the input and output elements 20, 16. As stated earlier, the child security assembly 23 includes the connector 100. The connector 100 moves between the first position in which the connector connects the input and output elements 20, 16 to transfer motion along the first path, and the second position in which the connector does not connect the input and output elements to interrupt motion transfer between the input and output elements.

The child security assembly 23 further includes an actuator assembly pivotally mounted on the enclosure 12 and supporting the connector 100. The actuator assembly includes several elements. First is an elongated switch tab 120. The switch tab 120 is adapted to extend to a portion of the door accessible to a human operator. In one example, the switch tab 120 extends through a slot in the side of the vehicle door (not shown). The operator can engage or disengage the child security assembly 23 by manipulating the switch tab 120. The switch tab 120 connects either directly or indirectly with the connector 100. In this manner, the switch tab 120 may move the connector 100 from the first position to the second position, or the reverse. In the present case, the switch tab 120 is linked to the connector 100 by a two-piece articulated assembly. The switch tab 120 itself is mounted on a tab support 122. The tab support 122 mounts to the enclosure 12 with the screw 123, and the tab support 122 may rotate about an axis defined by the screw 123. A connector support 124 is pivotally mounted on an end of the tab support 122 remote from the tab 120 with a fastener such as a locking tab, rivet, screw, etc. The connector 100 is mounted on the connector support 124. In the present case, the connector 100 is molded as an integral part of the connector support 124. The connector 100 has a flared end or head 126 to maintain the connector in the slots 94, 96. The tab support 122 is pivotally attached to the enclosure with a screw, fastener such as a locking tab, rivet, screw, etc.

The tab support 122 includes a flexible spring tab 128 adapted to engage the enclosure 12 to maintain the child security assembly 23 in one of the first and second positions absent a predetermined force moving the child security assembly into the other of the positions. The spring tab 128 includes a finger or nub 130 on its distal end to extend into one of two indentations or holes 132 formed in the enclosure 12. The spring tab 128 biases the finger 130 into one of the indentations 132, and this mechanical action retains the child security assembly 23 in one of the two positions until a force is applied to overcome the force of the spring tab 128 biasing the finger 130 into one of the indentations 132.

Figure 3C:
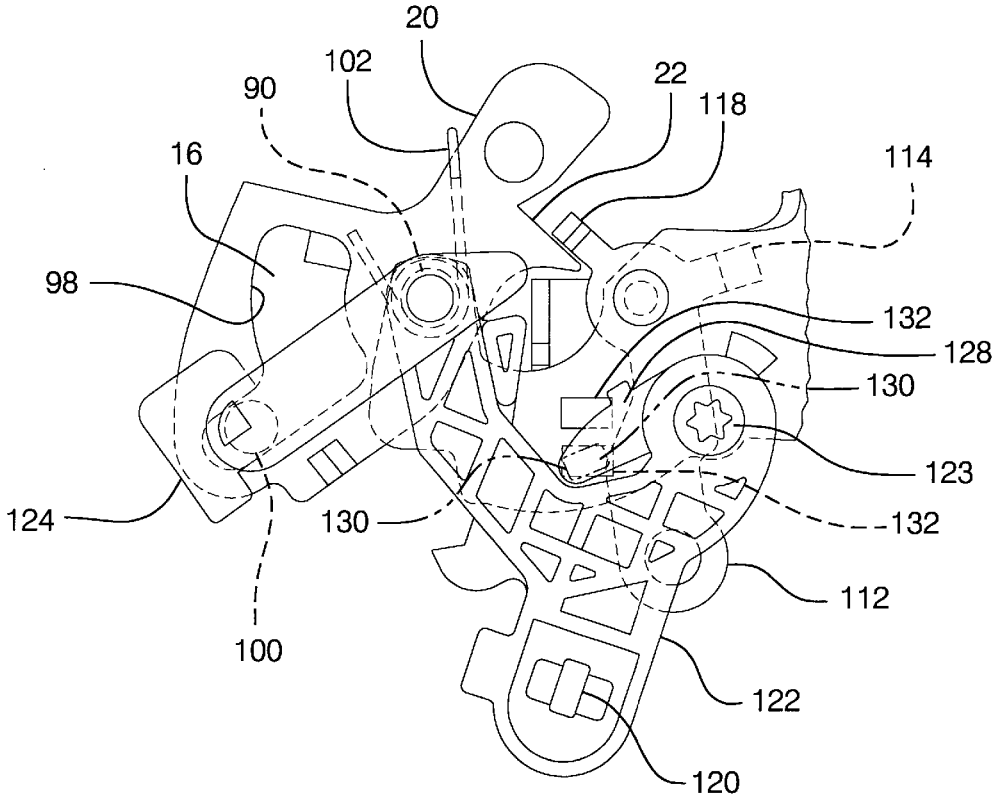
FIG. 3C is a view similar to that shown in FIG. 3A, but showing the child security assembly disengaged.
Figure 3D:
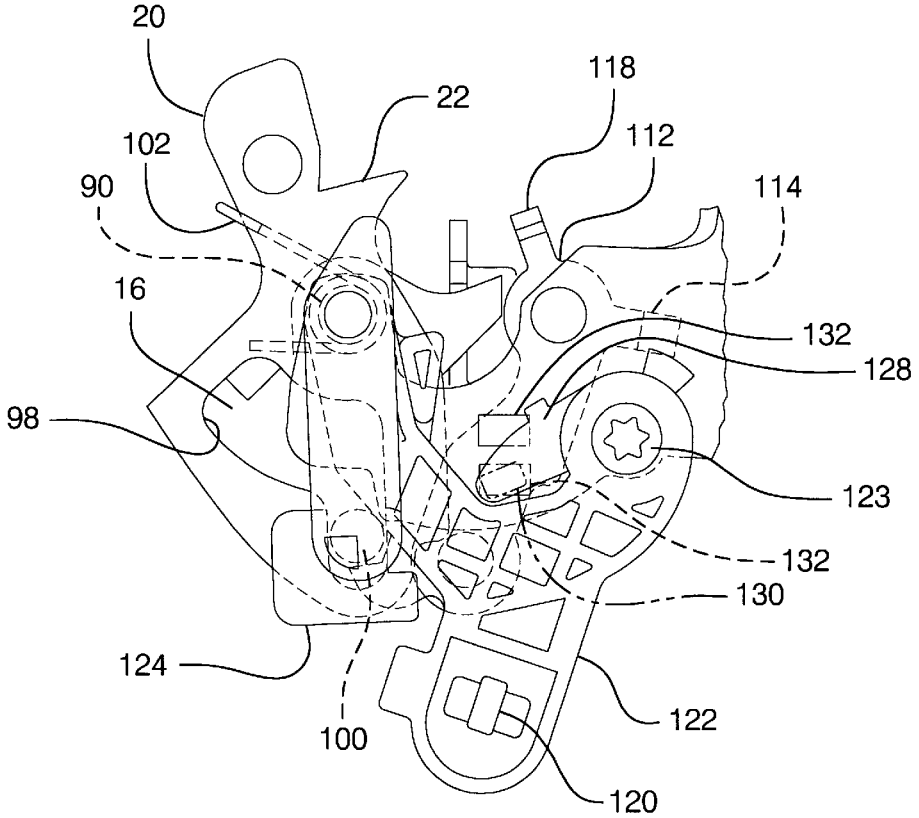
FIG. 3D is a view similar to that shown in FIG. 3C, but showing the latch handle assembly in the unlatching position.

The child security assembly 23 operates as follows. FIGS. 3C and 3D show the child security assembly 23 in the first (i.e., disengaged) position. The connector 100 extends through the elongated slot 96 in the input element 20 at the first end, and through the elongated slot 94 in the transfer plate 16 of the output element at the first end, where the two elongated slots 94, 96 are aligned. In this first position, the connector 100 transfers motion from the input element 20 to the transfer plate 16. As shown in FIG. 3D, the transfer plate 16 rotates about pin 90 when the input element 20 rotates about the pin 90, and motion transfers from the input element 20 eventually to the latch assembly 13 to unlatch the latch assembly.

FIGS. 3A and 3B show the child security assembly 23 in the second (or disengaged) position. The child security assembly 23 arrives in this position when a force is applied to the switch tab 120 biasing the switch tab clockwise as shown in FIGS. 3A–3D. The force must be able to overcome the spring tab 128 to move the finger 130 out of the bottom of the indentations 132. When this force is applied, the tab support 122 rotates clockwise about the screw 123, causing the connector support 124 to pivot, which moves the connector 100 to the second end of the elongated slots 94, 96. With the connector 100 positioned there, it transfers no motion from the input element 20 to the transfer plate 16 because it rides along the arcuate slot 98 in the input element 20, allowing the input element to freewheel with respect to the transfer plate 16. The spring tab 128 biases the finger 130 into the top of the indentations 132 to retain the child security assembly in the second position until an appropriate force moves the child security assembly 23 back into the first position.

Method

There is yet another statement of the invention wherein the invention may be viewed as a method for unlocking a vehicle door latch mechanism. It is a method of using some apparatus—not necessarily the aforesaid apparatus—to unlock and unlatch a door having a child security assembly. Thus, the method assumes that the door latch mechanism generally includes the following basic elements. These elements may correspond to items already described, but not necessarily. First is some type of latch adapted to secure a vehicle door when the door closes. Next is an inside latch handle movable between a latching position and an unlatching position wherein the latch unlatches the vehicle door. This inside latch is operable from the inside of the door. An outside latch handle is similarly movable between a latching position and an unlatching position. The outside latch is operable from the outside of the door. A lock is disposed somewhere in the latch mechanism. It is adapted to move from a locking position in which the lock prevents the inside and outside latch handles from unlatching the door, and an unlocking position in which the lock allows the latch handles to unlatch the door. A child security lock is associated with the inside latch handle and is adapted to move from a first position in which the inside handle may unlatch the latch, and a second position in which the child security lock prevents the inside handle from unlatching the latch.

The method includes the steps of: moving the child security lock to the second or engaged position; closing the vehicle door so that the vehicle door latches; moving the lock into the locked position; interrelating the inside latch handle and the lock so that the inside latch handle will unlock the vehicle door when the inside latch handle is moved to the unlatching position; and moving the inside latch handle to the unlatching position to unlock the door latch while the door latch remains latched. This "interrelating" step may be accomplished in the manner set forth above—i.e., by disposing an unlocking assembly between the inside latch handle assembly and the lock assembly. Numerous other ways to interrelate the latch handle assembly and the lock assembly will occur to persons of skill in the art—ways both mechanical and electrical.

The invention has been described in an illustrative manner, and it is to be understood that the terminology which has been used is intended to be in the nature of words of description rather than of limitation.

Obviously, many modifications and variations of the present invention are possible in light of the above teachings. Therefore, it is to be understood that within the scope of the appended claims, the invention may be practiced otherwise than as specifically described. Moreover, the reference numerals are merely for convenience and are not intended to be in any way limiting.

We claim:

1. A vehicle door latch mechanism having a locking assembly and a child security assembly comprising:

an enclosure:

a latch assembly mounted in said enclosure and adapted to latch under predetermined conditions;

an inside latch handle assembly mounted on said enclosure and operatively interconnected with said latch assembly to define a first motion transfer path wherein motion may be transferred from said inside latch handle assembly to said latch assembly, said inside latch handle assembly being mounted on said enclosure for movement from a rest position to an unlatching position to transfer motion along said first path to said latch assembly to unlatch said latch assembly;

an outside latch handle assembly mounted on said enclosure and operatively interconnected with said latch assembly to define a second motion transfer path wherein motion may be transferred from said outside latch handle assembly to said latch assembly, said outside latch handle assembly being mounted on said enclosure for movement from a rest position to an unlatching position to transfer motion along said second path to said latch assembly to unlatch said latch assembly;

a child security assembly mounted on said enclosure along said first path, said child security assembly being movable between a first position in which said child security assembly effects motion transfer along said first path, and a second position in which said child security assembly interrupts motion transfer along said first path to prevent said inside latch handle assembly from unlatching said latch assembly;

a lock assembly disposed on said enclosure along said first and second paths, said lock assembly being movable between an unlocking position in which said lock assembly effects motion transfer along said paths, and a locking position in which said lock assembly interrupts motion transfer along said paths; and an unlocking assembly disposed between said inside latch handle assembly and said lock assembly to move said lock assembly to said unlocking position without changing the position of said child security assembly when said inside latch handle assembly moves to said unlatching position.

2. The door latch mechanism of claim 1 wherein said unlocking assembly includes an abutment disposed on said inside handle assembly and a tab disposed on said lock assembly, said abutment engaging said tab when said inside handle assembly moves toward said unlatching position so that said inside handle assembly transfers motion to said lock assembly to move said lock assembly to said unlocking position.

3. The door latch mechanism of claim 2 wherein said inside handle assembly includes an input element pivotally mounted on said enclosure with a pivot pin, an output element mounted on said enclosure adjacent said input element, and an intermittent member pivotally mounted on said enclosure adjacent said output element, said input and output elements and said intermittent member being disposed in series along said first path, said input element including said abutment, said output element including a lever arm adapted to transfer motion to said intermittent member, said child security assembly including a connector moving between said first position in which said connector connects said input and output elements to transfer motion along said first path, and said second position in which said connector does not connect said input and output elements to avoid transferring motion between said input and output elements.

4. The door latch mechanism of claim 3 wherein said child security assembly further includes an actuator assembly pivotally mounted on said enclosure and supporting said connector, said actuator assembly including an elongated switch tab.

5. The door latch mechanism of claim 3 wherein said child security assembly further includes an actuator assembly pivotally mounted on said enclosure and supporting said connector, said actuator assembly including an elongated switch tab.

6. The door latch mechanism of claim 3 wherein said output element defines a first elongated slot extending radially from said pivot pin between a first end adjacent said pivot pin and a second end remote from said pivot pin, said input element defining a second elongated slot extending radially from said pivot pin between a first end adjacent said pivot pin and a second end remote from said pivot pin, said input element further defining an arcuate slot having an arc center at said pivot pin and extending generally from a first end coextensive with said second end of said elongated slot to a second end remote from said elongated slot.

7. The door latch mechanism of claim 6 wherein said connector is disposed through said elongated slot in said input element at said first end, and through said elongated slot in said output element at said first end, with said elongated slots being aligned when said connector is in said first position.

8. The door latch mechanism of claim 7 wherein said connector is disposed through said elongated slots at said second ends of said slots when said connector is in said second position, said connector moving along said arcuate slot toward said second end of said arcuate slot when said input element moves from said rest position to said unlatching position.

9. A vehicle door latch mechanism including a lock assembly and a child security assembly comprising:

an enclosure;

a latching assembly disposed in said enclosure and adapted to move from an unlatched configuration to a latched configuration;

an intermittent member engaging said latching assembly and movable from a rest position to an unlatched position in which said intermittent member moves said latching assembly into said unlatched configuration;

an inside latch handle assembly and an outside latch handle assembly, each said latch handle assembly disposed adjacent said intermittent member for movement from a rest position to an unlatching position to engage said intermittent member and move said intermittent member to said unlatched position;

a lock assembly disposed in said enclosure and engaging said intermittent member, said lock assembly being movable between an unlocked position in which said lock assembly positions said intermittent member so that said intermittent member engages said inside and outside latch handle assemblies when either of said latch handle assemblies move toward said unlatching position, and a locked position in which said lock assembly isolates said intermittent member from said inside and outside latch handle assemblies;

said inside latch handle assembly including an output element disposed adjacent said intermittent member, and an input element positioned adjacent said output element and said lock assembly, said input element including an abutment moving said lock assembly to said unlocked position when said input element of said inside latch handle assembly moves from said rest position to said unlatching position; and a child security assembly disposed between said input and output elements of said inside latch handle assembly movable between a first position in which said child security assembly transfers motion between said input and output elements, and a second position in which said child security assembly transfers no motion between said input and output elements whereby said inside latch handle assembly cannot engage said intermittent member to move said latching assembly to said unlatched configuration.

10. A method for unlocking a vehicle door latch mechanism where the door latch mechanism includes: a latch adapted to secure a vehicle door when the vehicle door closes; an inside latch handle movable between a latching position and an unlatching position wherein the latch unlatches the vehicle door; an outside latch handle movable between a latching position and an unlatching position wherein the latch unlatches the vehicle door; a lock adapted to move from a locking position in which the lock prevents the inside and outside latch handles from unlatching the door, and an unlocking position in which the lock allows the latch handles to unlatch the door; and a child security lock associated with the inside latch handle and adapted to move from a first position in which the inside latch handle may unlatch the latch, and a second position in which the child security lock prevents the inside latch handle from unlatching the latch; the method including the steps of:

moving the child security lock to the second position;

closing the vehicle door so that the vehicle door latches;

moving the lock into the locked position;

interrelating the inside latch handle and the lock so that the inside latch handle unlocks the vehicle door when the inside latch handle is moved to the unlatching position; and moving the inside latch handle to the unlatching position to unlock the door latch while the door latch remains latched and while the child security lock remains in the second position.

* * * * *